US008721289B2

(12) United States Patent
John et al.

(10) Patent No.: US 8,721,289 B2
(45) Date of Patent: May 13, 2014

(54) FLOW BALANCING SLOT

(75) Inventors: Joshy John, Karnataka (IN); Rajnikumar Nandalal Suthar, Gujarat (IN); Rajaguru Nathan Krishnasamy, Tamil Nadu (IN)

(73) Assignee: General Electric Company, Schenectady, NY (US)

( * ) Notice: Subject to any disclaimer, the term of this patent is extended or adjusted under 35 U.S.C. 154(b) by 742 days.

(21) Appl. No.: 12/609,376

(22) Filed: Oct. 30, 2009

(65) Prior Publication Data

US 2011/0103966 A1 May 5, 2011

(51) Int. Cl.
*F01D 11/06* (2006.01)
*B64C 27/20* (2006.01)

(52) U.S. Cl.
USPC ..... 416/191; 416/195

(58) Field of Classification Search
USPC ..... 416/189, 191, 192, 194, 195, 196 R
See application file for complete search history.

(56) References Cited

U.S. PATENT DOCUMENTS 5,154,581 A * 10/1992 Borufka et al. ..... 416/190
5,261,785 A * 11/1993 Williams ..... 415/169.2
5,531,568 A * 7/1996 Broadhead ..... 416/97 R
6,736,596 B2 5/2004 Ito et al.
6,851,926 B2 2/2005 Guinessine et al.
6,851,931 B1 2/2005 Tomberg
6,893,216 B2 5/2005 Snook et al.
7,066,713 B2 * 6/2006 Dube et al. ..... 415/173.5
7,396,205 B2 * 7/2008 Dube et al. ..... 415/173.5
2008/0019835 A1 1/2008 McFeat et al.

FOREIGN PATENT DOCUMENTS

JP 2001193405 7/2001
JP 2002223277 8/2002

OTHER PUBLICATIONS

Chinese Office Action issued Jan. 30, 2014 in CN Application No. 201010539370.4, 16 pages.

* cited by examiner

*Primary Examiner* — Ned Landrum
*Assistant Examiner* — Ryan Ellis
(74) *Attorney, Agent, or Firm* — Cantor Colburn LLP

(57) ABSTRACT

A cover of an airfoil having opposing pressure and suction sides of a rotatable turbine stage to prevent fluid from cross-over-flowing from a pressure side of a leading airfoil to a suction side of a trailing airfoil is provided. The cover includes pressure and suction side edge portions, one of which having a shape that is discontinuous relative to that of a complementary one of suction and pressure side edge portions of an aft cover of a corresponding one of a trailing and a leading airfoil, respectively.

13 Claims, 5 Drawing Sheets

FLOW BALANCING SLOT

BACKGROUND OF THE INVENTION

The subject matter disclosed herein relates to a flow balancing slot.

Tip clearance losses in a turbine bucket typically constitute 20-25% of the total losses in the blade row. These losses generally occur due to high energy flow escaping through the clearance region without doing any useful work, mixing of tip leakage flow and passage flow downstream of the bucket and flow from the pressure surface of the airfoil crossing over to the suction surface. A lift force generated by the airfoil and a torque on the blade row are, thus, reduced.

The instance of flow crossover has been addressed by the installation of a cover on the bucket. The cover diverts flow away from the crossover region and decreases the losses associated with crossover flow.

The shape and size of the cover can influence the amount of the flow that is diverted and can thereby influence the level of the decreased losses. Unfortunately, mechanical constraints often require the cover to be scalloped and the scallop introduces an additional loss in the form of intrusion losses. Intrusion losses result from the in-out flow through the scallop and further increase downstream mixing losses. That is, in conventional bucket covers, flow leaving from an aft scallop region of the bucket cover re-enters the main flow and interacts with a horseshoe vortex propagating therein and, thus, increases a size and intensity of a flow-mixing loss region.

BRIEF DESCRIPTION OF THE INVENTION

According to one aspect of the invention, a cover of an airfoil having opposing pressure and suction sides of a rotatable turbine stage to prevent fluid from crossover-flowing from a pressure side of a leading airfoil to a suction side of a trailing airfoil is provided. The cover includes pressure and suction side edge portions, one of which having a shape that is discontinuous relative to that of a complementary one of suction and pressure side edge portions of an aft cover of a corresponding one of a trailing and a leading airfoil, respectively.

According to another aspect of the invention, a rotatable turbine stage of a turbine engine is provided and includes a first aft cover of a first airfoil having opposing pressure and suction sides and a second aft cover of a second airfoil having opposing pressure and suction sides that immediately leads the first airfoil in a direction of turbine stage rotation. The first and second aft covers respectively include complementary pressure and suction side edge portions, one of which has a shape that is at least partially discontinuous relative to that of the other to prevent fluid from crossover-flowing from the pressure side of the second airfoil to the suction side of the first airfoil.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features without limitation, by way of example with reference to the drawings.

DETAILED DESCRIPTION OF THE INVENTION

Figure 1:
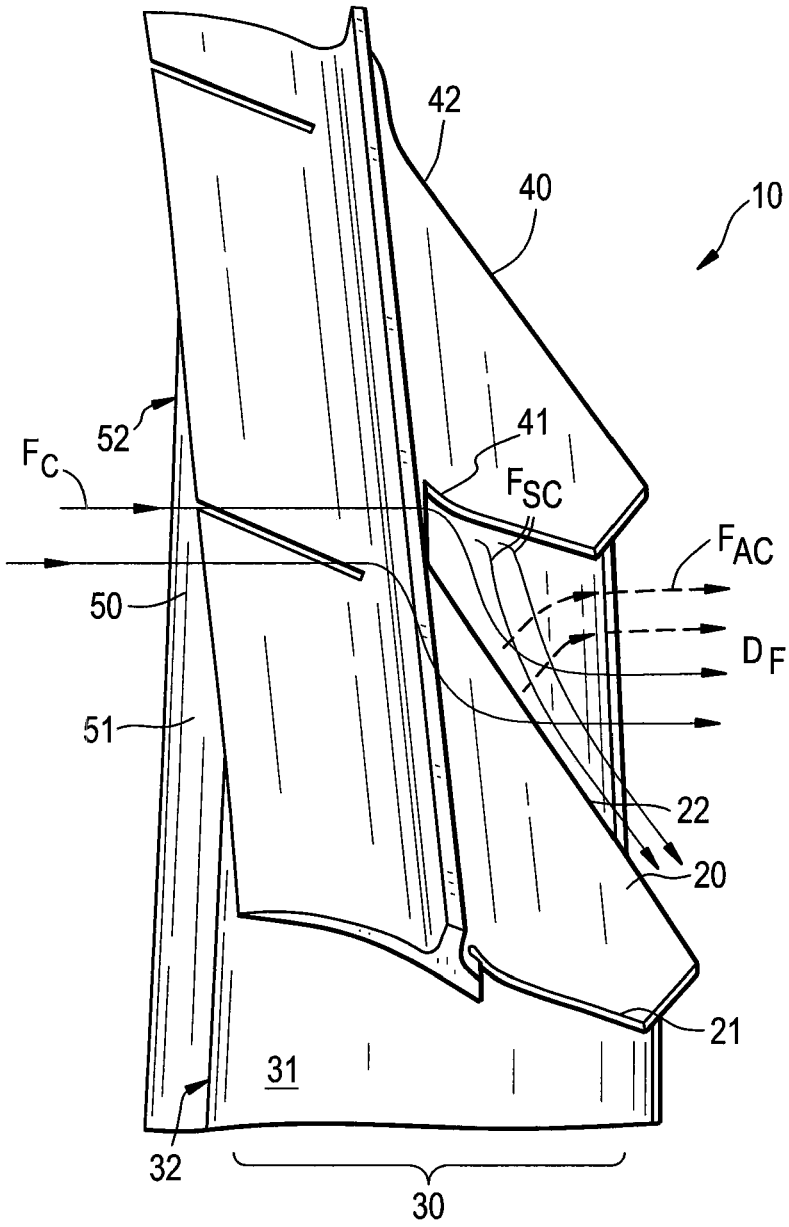
FIG. 1 is a perspective view of a turbine stage of a turbine engine.
Figure 2:
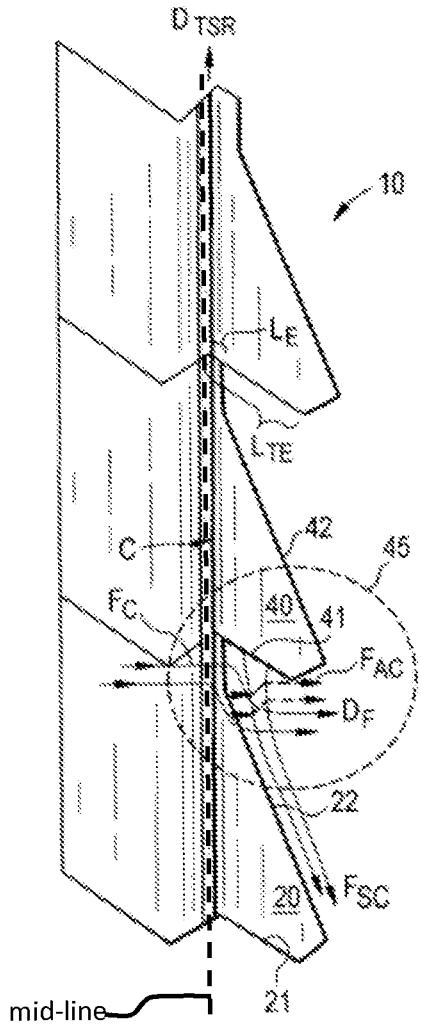
FIG. 2 is an enlarged radial view of the turbine stage of FIG. 1.
Figure 3:
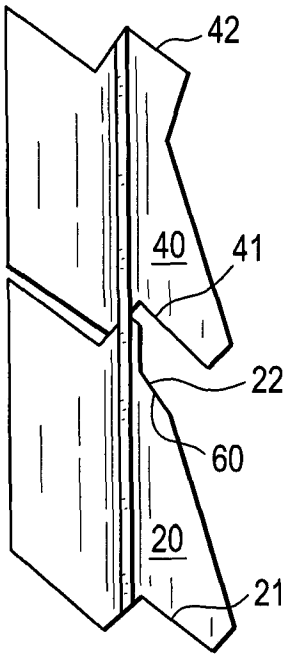
FIGS. 3-7 are enlarged radial views of the turbine stage of FIG. 1 in accordance with various embodiments.
Figure 4:
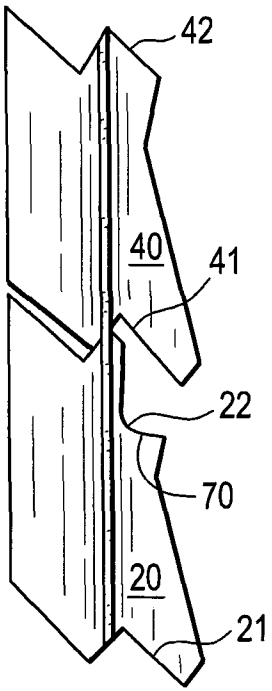

With reference to FIGS. 1 and 2, a rotatable turbine stage 10 of a turbine or gas turbine engine is provided. The turbine stage 10 may include a first aft cover 20 of a first airfoil 30 and a second aft cover 40 of a second airfoil 50. The first airfoil 30 includes a pressure side 31 and a suction side 32 and the second airfoil 50 includes a pressure side 51 and a suction side 52. The first airfoil 31 immediately trails the second airfoil 50 relative to a direction of turbine stage rotation $D_{TSR}$ and at least one of the first and second aft covers 20 and 40 of the first and second airfoils 30 and 50 is formed to prevent fluid $F_{SC}$, such as passage flow, from crossover-flowing from a pressure side 51 of the second airfoil 50 to a suction side 32 of the first airfoil 30.

The first aft cover 20 includes a pressure side edge portion 21 and a suction side edge portion 22 arranged relative to the direction of turbine stage rotation $D_{TSR}$ (see FIG. 2). Similarly, the second aft cover 40 includes a pressure side edge portion 41 and a suction side edge portion 42. One of the pressure side edge portions 21 and 41 and the suction side edge portions 22 and 42 has a shape that is at least partially discontinuous relative to a shape of its complement. For example, as shown in FIG. 2, the suction side edge portion 22 of the first aft cover 20 has a shape that is discontinuous relative to a shape of the pressure side edge portion 41 of the second aft cover 40. This discontinuity forms a flow balancing slot 45 which directs fluid $F_{AC}$, such as relatively high energy fluid leaving the first and second aft covers 20 and 40, to flow in a direction $D_F$, which is at least partially substantially transverse and radially outwards to the direction $D_{TSR}$.

The fluid $F_{AC}$ directed by the flow balancing slot 45 may flow to a turbine casing of the turbine perimetrically surrounding the turbine stage 10. The flow balancing slot 45 may also align the fluid $F_{AC}$ with the fluid $F_C$ to reduce a size of a loss region and/or to provide a higher backpressure to the fluid $F_C$ to reduce flows through a clearance region.

Simulation of turbine engines has indicated that the presence of the flow balancing slot 45 results in increased efficiency due to reductions of overall flow mixing loss regions and tip leakage flows. The flow balancing slot 45 also reduces an overall weight of a bucket cover and lengthens its lifetime. The use of the flow balancing slot 45 can be applied to all new turbines and as part of an upgrade package.

With reference to FIGS. 2-7, the discontinuity forming the flow balancing slot 45 may be located at the suction side edge portion 22. As shown in the examples of FIG. 2, the suction side edge portion 22 may have an axial length $L_E$ which is shorter than an axial length $L_{TE}$ of the pressure side edge portion 41 where $L_E$ and $L_{TE}$ are measured along a same line intersecting with an axial centerline C of the turbine stage 10. The axial discontinuity can result from the suction side edge portion 22 being formed with an angular shoulder 60 (see FIG. 3) including substantially straight edges, or with a concave rounded shoulder 70 (see FIG. 4) including a continuous rounded edge.

Figure 5:
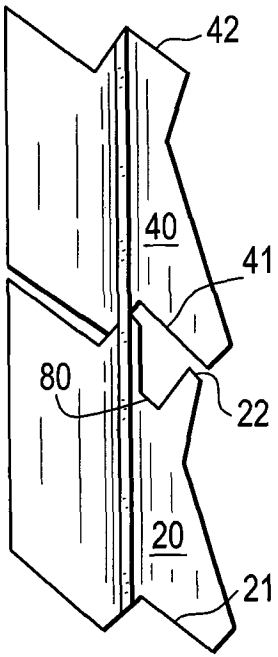
Figure 6:
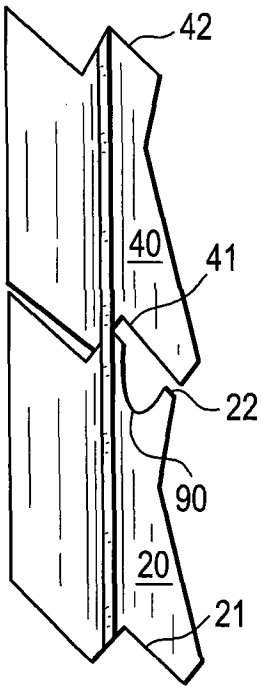

In alternate embodiments where the discontinuity is found in the suction side edge portion 22, as shown in the examples of FIGS. 5 and 6, the suction side edge portion 22 may be formed with an angular recess 80 (see FIG. 5) including substantially straight edges, or with a concave rounded recess 90 (see FIG. 6) including a continuous rounded edge.

Figure 7:
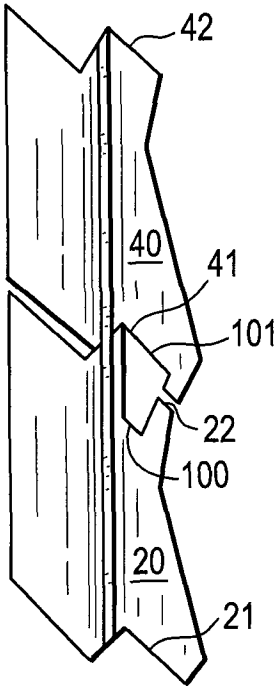

With reference to FIG. 7, both the suction side edge portion 22 and the pressure side edge portion 41 may be the locations of discontinuities. That is, in the example of FIG. 7, both the suction side edge portion 22 and the pressure side edge portion 41 are formed with opposing recesses 100 and 101, respectively. Although illustrated as being angular recesses, it is understood that these recesses could also be concave rounded recesses.

It is further understood that the various embodiments shown in FIGS. 2-7 can be jointly or separately interchangeable with one another with departing from the scope of the various aspects of the invention.

In accordance with another aspect of the invention, a method of operating a turbine stage 10 of a turbine engine is provided and includes preventing a first fluid $F_{SC}$ from crossover-flowing from, e.g., a pressure side 51 of a leading airfoil 50 to a suction side 32 of a trailing airfoil 30. The method further includes directing a second fluid $F_{AC}$ leaving the aft cover 20, 40 to flow in a direction $D_F$. The direction $D_F$ is at least initially substantially transverse to a direction of turbine stage rotation $D_{TSR}$. As described above, the preventing of the first fluid $F_{SC}$ from crossover-flowing from the pressure side 51 of the leading airfoil 50 to the suction side 32 of the trailing airfoil 30 is achieved by a forming of a flow balancing slot 45 proximate to at least one of a suction side edge portion 22, 42 and a pressure side edge portion 21, 41 of the aft cover 20, 40.

Figure 8:
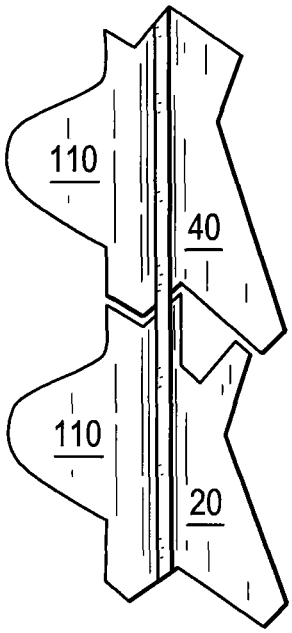
FIG. 8 is an enlarged radial view of the turbine stage of FIG. 1 in accordance with further embodiments.

With reference to FIG. 8, it is understood that the configurations of the aft cover 20, 40 described above can be associated with varying configurations of the forward cover 110. For example, the forward cover 110 can be configured as shown in FIGS. 1-7 or scalloped as shown in FIG. 8.

Figure 9:
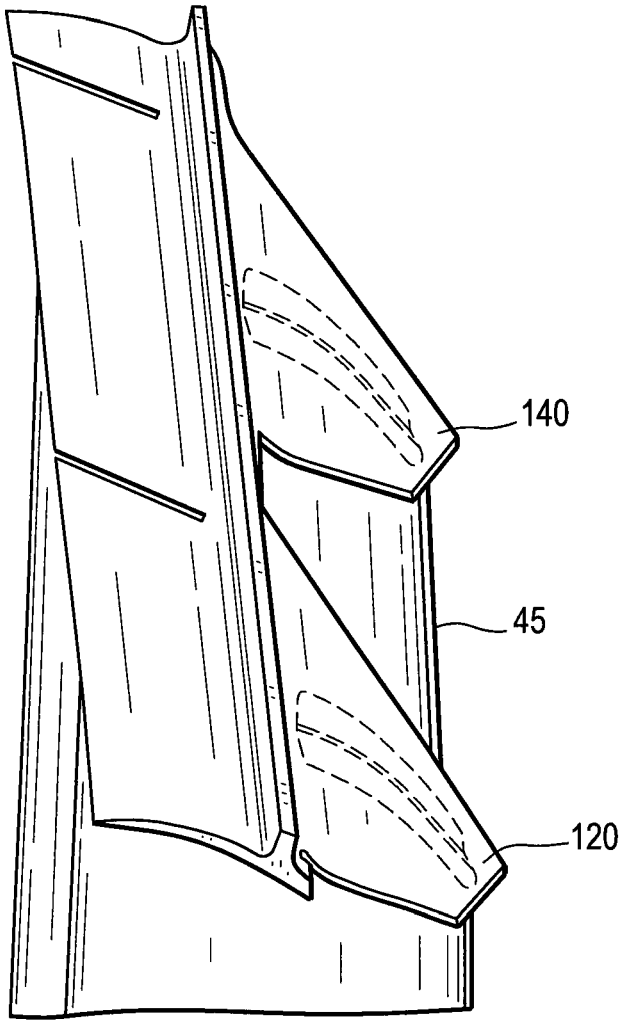
FIG. 9 is a perspective view of the turbine stage of FIG. 1 having non-axis-symmetric aft covers.

With reference to FIG. 9, it is further understood that the flow balancing slot 45 can be formed between aft covers 120 and 140 having non-axis-symmetric shroud shapes.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A cover of an airfoil having opposing pressure and suction sides of a rotatable turbine stage to prevent fluid from crossover-flowing from a pressure side of a leading airfoil to a suction side of a trailing airfoil, the cover comprising:

a cover body including a pressure side having a forward edge, which is substantially parallel with a mid-line, and a suction side having an aft edge, which is transversely oriented relative to the mid-line, such that the pressure and suction sides provide coverage area at the pressure side that is greater than coverage area at the suction side; and pressure and suction side edge portions, one of which having a shape that is angularly discontinuous relative to that of a complementary one of suction and pressure side edge portions of an aft cover of a corresponding one of a trailing and a leading airfoil, respectively, wherein the forward edge of the pressure side of the cover body is substantially straight along a circumferential dimension and the aft edge of the suction side of the cover body includes multiple edges that are each transversely oriented relative to the circumferential dimension.

2. The cover according to claim 1, wherein the discontinuous one of the pressure and suction side edge portions directs fluid in a direction at least partially substantially transverse to a direction of the turbine stage rotation.

3. The cover according to claim 1, wherein the suction side edge portion is the discontinuous shape.

4. The cover according to claim 3, wherein the suction side edge portion is shorter in an axial direction than the complementary pressure side edge portion.

5. The cover according to claim 1, wherein the one of the pressure and suction side edge portions that has the shape that is angularly discontinuous relative to that of the complementary one of the suction and pressure side edge portions is formed of transverse edges that form an obtuse angle including a single converging point at which the transverse edges meet.

6. The cover according to claim 1, wherein the one of the pressure and suction side edge portions that has the shape that is angularly discontinuous relative to that of the complementary one of the suction and pressure side edge portions comprises:

a first edge that is adjacent to and extends along the complementary one of the suction and pressure side edge portions; and a second edge that extends away from the complementary one of the suction and pressure side edge portions such that the second edge forms an obtuse angle including a single converging point with the first edge at which the first and second edges meet.

7. The cover according to claim 1, wherein the cover body comprises:

a first portion of the pressure side, which is swept toward the trailing airfoil;

a second portion of the pressure side, which is swept toward the trailing airfoil;

a first portion of the suction side, which is swept toward the leading airfoil; and a second portion of the suction side, which is swept toward the leading airfoil, the first and second portions of the pressure side being larger than the first and second portions of the suction side.

8. A rotatable turbine stage of a turbine engine, comprising:

a first aft cover of a first airfoil having opposing pressure and suction sides, the pressure side having a forward edge, which is substantially parallel with a mid-line, and a suction side having an aft edge, which is transversely oriented relative to the mid-line; and a second aft cover of a second airfoil having opposing pressure and suction sides that immediately leads the first airfoil in a direction of turbine stage rotation, the pressure side having a forward edge, which is substantially parallel with a mid-line, and a suction side having an aft edge, which is transversely oriented relative to the mid-line, respective coverage areas at the respective pressure sides of each of the first and second aft covers being greater than respective coverage areas at the respective suction sides thereof; and the first and second aft covers respectively including complementary pressure and suction side edge portions, one of which has a shape that is at least partially angularly discontinuous relative to that of the other to prevent fluid from crossover-flowing from the pressure side of the second airfoil to the suction side of the first airfoil, wherein the forward edge of the pressure side of the cover body is substantially straight along a circumferential dimension and the aft edge of the suction side of the cover body includes multiple edges that are each transversely oriented relative to the circumferential dimension.

9. The turbine stage according to claim 8, wherein the discontinuous one of the pressure and suction side edge portions directs fluid in a direction at least partially substantially transverse to a direction of the turbine stage rotation.

10. The turbine stage according to claim 8, wherein the suction side edge portion comprises the discontinuous shape.

11. The turbine stage according to claim 10, wherein the suction side edge portion is shorter in an axial direction than the pressure side edge portion.

12. The turbine stage according to claim 8, further comprising a scalloped cover of at least one of the first and the second airfoils.

13. The turbine stage according to claim 8, wherein at least one of the first and second aft covers has a non-axis-symmetric shape.

* * * * *